United States Patent [19]

Haley et al.

[11] Patent Number: 4,819,329

[45] Date of Patent: Apr. 11, 1989

[54] METHOD OF MANUFACTURING MULTIWIRE LEAD ASSEMBLIES

[75] Inventors: Thomas W. Haley, Minneapolis; Vladimir Drits, Minnetonka; Dale R. Johnson, St. Louis Park, all of Minn.

[73] Assignee: Innovex Inc., Hopkins, Minn.

[21] Appl. No.: 94,569

[22] Filed: Sep. 9, 1987

[51] Int. Cl.[4] ..... H01R 43/00; H01R 43/02

[52] U.S. Cl. ..... 29/860; 29/858; 29/861

[58] Field of Search ..... 29/857, 858, 860, 861, 29/867, 872

[56] References Cited

U.S. PATENT DOCUMENTS 4,196,510 4/1980 Gudmestad ..... 29/867

*Primary Examiner*—Howard N. Goldberg
*Assistant Examiner*—Taylor J. Ross
*Attorney, Agent, or Firm*—Kinney & Lange

[57] ABSTRACT

A method of manufacturing a multiwire lead assembly for a flexible connector between thin film elements and other electronic circuitry during manufacturing thin film heads for computer disc drives includes the process of supporting the multiple wires in spaced locations on retainers, such as terminal boards, and fixing the wires to such terminal boards. The terminal boards are spaced apart a desired distance for making the lead assembly. The wires are separated from the source reel and then the two terminal boards are a supported assembly and the center portions of the multiple wires are twisted together while the end portions are held separated and oriented by the terminal boards. The twisted wire portion of the wires then can be insulated at desired locations, including for example the full length of the twisted portion. The ends of the wires are stipped of their normal insulating coating utilizing a laser stripper in a known manner. The stripped areas are used for connection to two components that are to be electrically connected.

12 Claims, 3 Drawing Sheets

METHOD OF MANUFACTURING MULTIWIRE LEAD ASSEMBLIES

BACKGROUND OF THE INVENTION

1. Field of the Invention

The present invention relates to a method of manufacturing flexible lead assemblies for use with electronic components.

2. Description of the Prior Art

In the prior art, it has been difficult to make twisted wire leads for connecting electronic components where the individual wires are oriented in a particular sequence and remain in that sequence for connection after being twisted. The wires in the twisted bundle tend to get mixed up using conventional techniques so automated assembly is difficult.

SUMMARY OF THE INVENTION

The present invention relates to a method of making a flexible, multiple wire twisted lead assembly that is used as a flexible connector between electronic components such as thin film elements during manufacture of computer disc drives. It is necessary that the individual wires in a twisted wire lead assembly remain spaced and oriented at the opposite end so that they can be connected to terminals or thin film printed wire boards in an automated procedure. Maintaining the orientation of the wires during twisting has been a problem, but it is essential to do so for quick and easy operation.

The present process has easily performed steps and apparatus for accomplishing the twisting of the wires. The wire ends are oriented on wire retainers, then bundled and twisted. The twisted center portion is insulated and the wire ends are stripped. The lead assembly including the end retainers are mounted in a fixture which places the lead in position for connecting to the proper locations on the thin film devices. The connections are made in a conventional manner and then the end retainers are cut off. The use of retainers insures that the wires will be oriented and positioned properly.

DETAILED DESCRIPTION OF THE PREFERRED EMBODIMENTS

A multiple wire lead assembly indicated generally at 10 is used for connection between a thin film element, and other electronic components, primarily for use in thin film heads for computer disc drives. The multiple wire lead assembly 10 is made with a plurality of wires 11, 12, 13 and 14 which are color coded to different colors, and which are oriented so that they are in the same sequence on wire end retainers 15 and 16, which are short terminal boards as shown. The terminal boards can be replaced by other supports or holders opposed to straight boards, but are used for retaining the end portions of the wires 11, 12, 13 and 14 spaced apart in a sequential order from one side of each retainer to the other.

Figure 1:
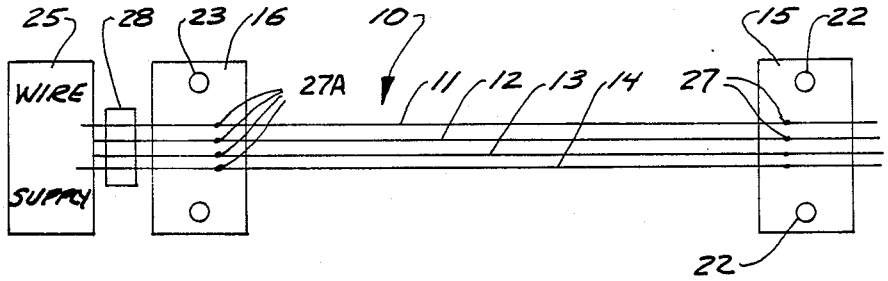
FIG. 1 is a top schematic view of a lead assembly showing wires in a first step of the process of manufacture according to the present invention.
Figure 2:
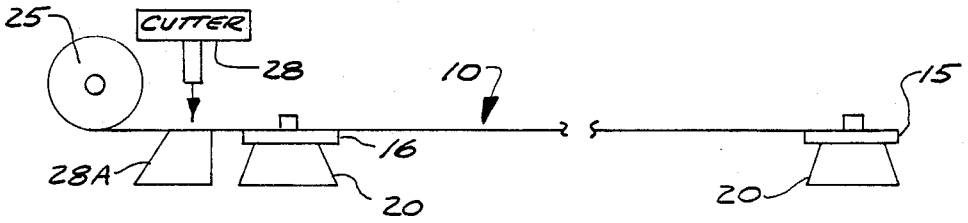
FIG. 2 is a schematic top view representation of the step shown in FIG. 1.

The process can be automated, and as shown in FIG. 1, spaced apart fixtures 20 are provided for supporting the wire retainers 15 and 16, respectively, at the correct spacing. The wire retainers or boards can be located with suitable pins 22 and 23 on the respective fixtures 20. A wire supply 25 is provided at one end and the individual wires 11, 12, 13 and 14 are pulled off the wire supply 25 and laid across the upper surfaces of the, wire retainers or boards 15 and 6. The wires 11–14 are apart as shown in FIG. 1. The wires are then affixed to the retainers or terminal boards 15 and 16 as by soldering or welding for example, as indicated at the dots shown at 27 and 27A, respectively, on the respective retainers. It should be noted that terminal boards 15 and 16 could for example have adhesive surfaces that retain the wires 11–14 at locations spaced the proper amount. The wires are pulled out to their required positions on the retainers or terminal boards 15 and 16 and then retained in place on the retainers or boards. A cutter of conventional design indicated at 28 is used for trimming the wires between the wire supply 25 and the terminal board 16 as shown in FIGS. 1 and 2. The cutter 28 is of conventional design acting against an anvil 28A.

Figure 3:
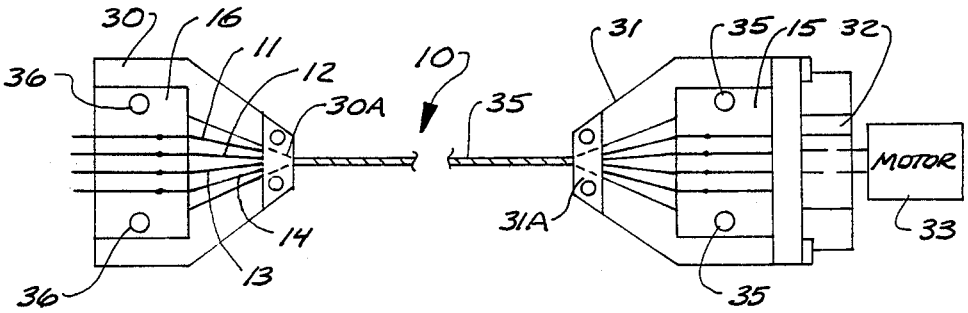
FIG. 3 is a top plan view of the lead assembly shown in FIG. 1 after a further step in the processing, and schematically shown in operating fixtures for providing twisting of the wires.
Figure 4:
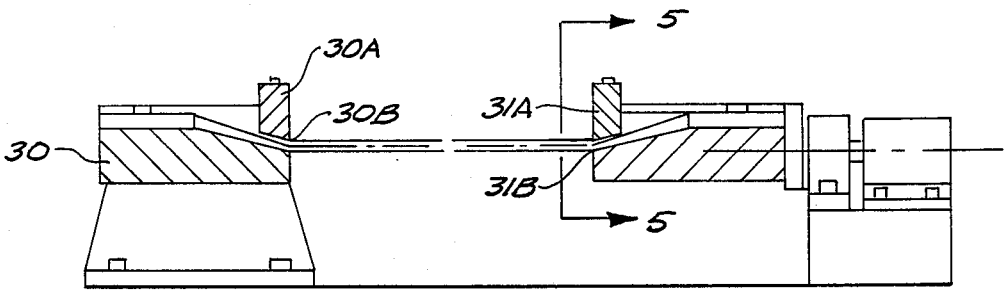
FIG. 4 is a sectional view of the fixture used in the assembly of FIG. 3.
Figure 5:
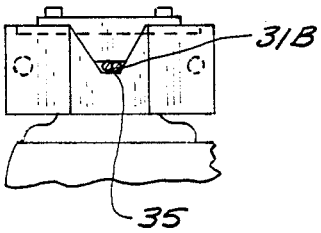
FIG. 5 is an end elevational view of a typical fixture used for twisting the wires and taken on line 5—5 in FIG. 4.

The next station is shown in FIGS. 3, 4 and 5, and comprises a stationary fixture 30 and a rotating fixture 31. The rotating fixture is rotatably mounted on a shaft mounted in a bearing 32. The shaft is driven from a motor 33 through a suitable gear. The fixtures 30 and 3 have tapered recesses at their facing ends so that when the retainers or terminal boards 15 and 16 are placed into their respective seats on mounting pins 35 and 36, respectively, and clamps 30A and 31A which as shown taper downwardly to fit the tapered recesses are fastened in place, the four wires in the lead assembly urged together into the narrow outlet openings shown at 30B and 31B. The wires 11–14 are thus held together in a bundle. The wires are held tightly at these outlet openings. Then, support 31 can be rotatably driven. As shown, the support 30 is rotated to provide a twisted center section of multiple wires indicated at 35, comprising a part of the lead assembly 10. The terminal boards 15 and 16 are continued to be held in their proper orientation so that the wires 11, 12, 13 and 14 are spaced apart and oriented with respect to each other so they can be attached to the respective components. The rotating fixture member 30 is stopped at its proper orientation so that the wires 11–14 are aligned on the wire retainers or terminal boards 15 and 16.

The multiple wire lead assembly 10 is then removed from the fixtures 30 and 31, and the twisted wire center portion 35 is supported in a mold indicated schematically at 40 that can be of any desired design, to provide for encapsulating the twisted wire portion 35 with an insulating material 41, such as a thermo-plastic material or other suitable insulation. While the entire twisted wire portion 35 is shown as being encapsulated, this step could be to encapsulate or cover only selected portions where clips or supports for the wire assembly 10 are to be applied.

Figure 6:
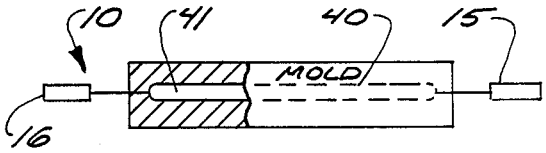
FIG. 6 shows the lead assembly schematically in a further step of forming wherein insulation material is applied at desired locations on the lead assembly.
Figure 7:
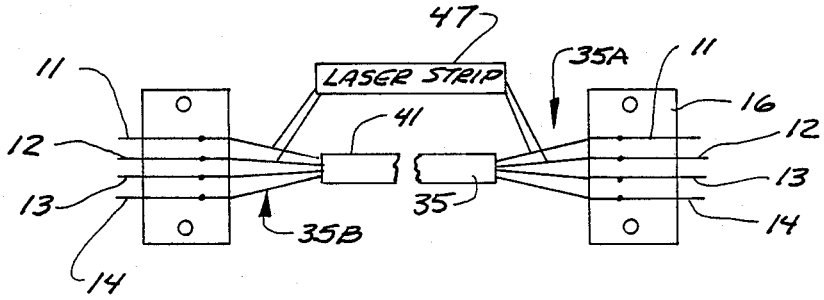
FIG. 7 schematically shows a step of stripping insulation from the end portion of the wires, utilizing laser stripping methods.

Once the insulation material 41 is molded in place, the assembly 10 is then placed into a suitable fixture such as that shown in FIG. 6, and a laser stripping unit indicated at 47, respectively, are used for stripping off the standard thin insulating coating on the wires 11, 12, 13 and 14 at the ends in the tapered sections shown at 35A and 35B. The stripped wires provide a place for electrical connections. The retainers or terminal boards 15 and 16 are then put in place on a robot fixture for example, and then placed in a desired location with the stripped portions of the wire in contact with portions of the circuits they are connecting. The connections are soldered in a conventional manner and the terminal boards cut off.

The wires are held in a very precise position during the operation because they are oriented with the retainers 15 and 16. The retainers are used for handling and orienting the wires. The movement of the retainers or terminal boards can be accomplished quite easily by using fixtures that hold the retainers once they are removed from their stations where operations are taking place, and once the laser stripping has occurred, the entire lead wire assembly can then be placed into a fixtured process for further use as desired.

The molded material 41 not only provides for an insulation, but helps hold the wires in a bundle, so that they can be handled quite easily without fear of scraping off insulation or breaking them.

Figure 8:
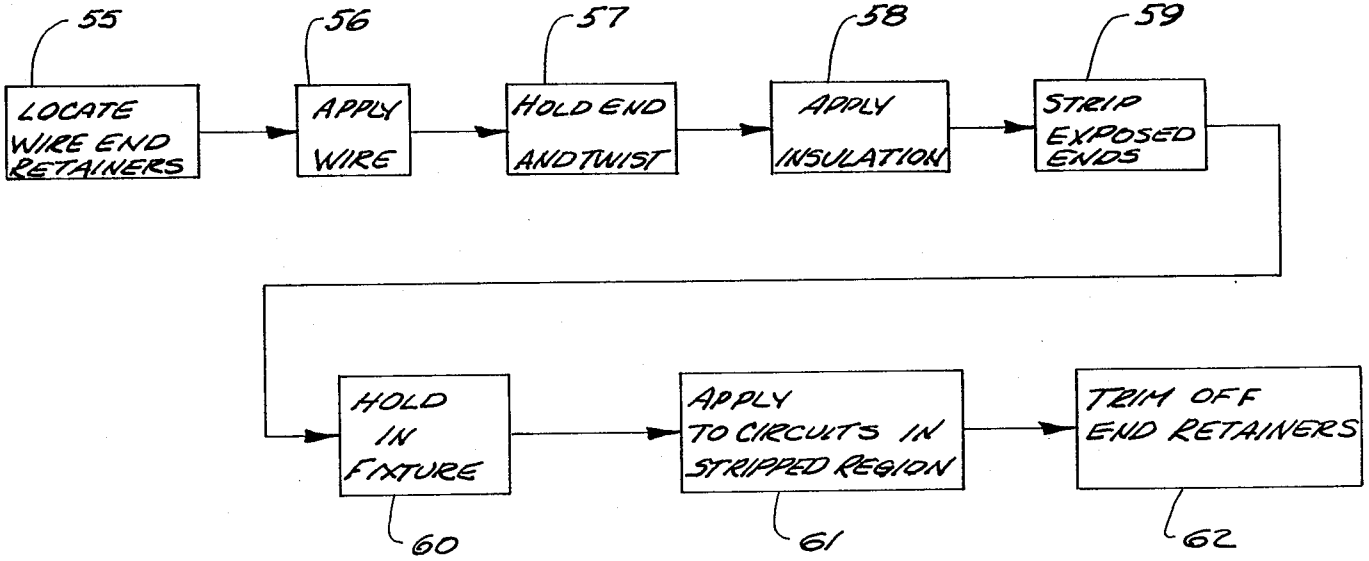
FIG. 8 is a block flow diagram of the steps for making the multiple wire lead assembly of the present invention.

The process thus requires simple apparatus for carrying out, and as shown in FIG. 8 includes the distinct steps of locating the wire end retainers as shown in the box 55, applying the wires as shown by the step 56, which would be applying the wires to the end retainers in a desired orientation and precisely positioned; holding the wire end retainers and then twisting the assembly as shown by step 57; applying insulation at clamping locations such as that shown by step 58; and stripping the exposed wires in desired regions, as explained using laser stripping which is a simple precise way of obtaining stripping which is represented by step 59. The multiple wire lead assembly can be further processed as desired, and as represented at 60 the end retainers can be held in a fixture, such as a robot fixture, moved to a proper location and connected to circuits in the stripped regions as represented at 61; and then the end retainers are trimmed off by cutting the wires at locations between the connections to the circuits and the end retainers, as represented at 62.

What is claimed is:

1. A method of manufacturing multiwire lead assemblies comprising the steps of:

positioning multiple wire retainers at desired spaced locations;

placing the wires on the retainers and affixing end portions of the wires thereto in a desired orientation;

retaining the end portions of the wires spaced apart and twisting center portions to form a twisted wire portion;

providing insulation material for protecting the twisted wire portion in at least selected sections thereof; and forming locations where contacts can be made to the wires adjacent to the wire retainers.

2. The method of claim 1 wherein said step of providing wire retainers comprises the step of providing terminal boards, at spaced apart locations, and the step of twisting includes moving the individual wires together to be adjacent each other at spaced locations prior to the twisting step.

3. The method of claim 2 wherein said step of twisting comprises rotating at least one of the wire retainer members relative to the other.

4. The method of claim 1 wherein the step of providing insulation material comprises the step of encapsulating at least portions of the twisted wire portion subsequent to the twisting step.

5. The method of claim 1 wherein the step of providing contact locations on the wires comprises laser stripping the wires at areas adjacent to the wire retainers and spaced from the twisted wire portion.

6. The method of claim 1 wherein the step of retaining the wires on retainers comprises welding the wires to a portion of the retainers in spaced apart locations oriented to be substantially identical to the locations on the opposite retainer.

7. The method of claim 1 wherein the step of providing insulation material on the twisted wire portion comprises the step of encapsulating substantially the entire length of the twisted wire portion.

8. The method of claim 1 including the step of cutting the wires to remove the wire retainers after the lead assembly has been connected to desired circuit assemblies.

9. A method of manufacturing multiwire lead assemblies comprising the steps of:

positioning multiple wire retainers at desired locations along a longitudinal axis;

affixing opposite end portions of a plurality of wires to be formed into a lead assembly on the respective wire retainers in a desired orientation;

retaining the end portions of the wires spaced apart and twisting the wires to provide a twisted wire center section by rotating one retainer relative to a second retainer about said axis; and providing electrical contact locations on the wires adjacent to the opposite end portions.

10. The method of claim 9 wherein said step of positioning multiple wire retainers comprises the step of providing terminal boards forming the retainers at spaced apart locations and the affixing step comprises affixing the wires to the terminal boards.

11. The method of claim 9 and including the step of providing insulation material for protecting the twisted wire center section by encapsulating at least sections of the twisted wire center section subsequent to the rotating step.

12. The method of claim 9 wherein prior to the step of rotating the one retainer, the wires are positioned adjacent each other at positions spaced from each of the retainers.

* * * * *